US006629478B2

(12) United States Patent
Kozak

(10) Patent No.: US 6,629,478 B2
(45) Date of Patent: Oct. 7, 2003

(54) HAND TOOL DEVICE WITH OPPOSING DRIVE ENDS AND STORAGE FOR MULTIPLE TOOL BITS

(76) Inventor: Burton Kozak, 1300 N. Lake Shore Dr., #28C, Chicago, IL (US) 60610

( * ) Notice: Subject to any disclaimer, the term of this patent is extended or adjusted under 35 U.S.C. 154(b) by 0 days.

(21) Appl. No.: 09/918,958

(22) Filed: Jul. 31, 2001

(65) Prior Publication Data

US 2003/0024356 A1 Feb. 6, 2003

(51) Int. Cl.[7] ..... B25B 23/16
(52) U.S. Cl. ..... 81/490; 81/177.4
(58) Field of Search ..... 81/438, 439, 177.4, 81/490

(56) References Cited

U.S. PATENT DOCUMENTS 1,250,328 A * 12/1917 Langford ..... 81/177.4
4,278,119 A * 7/1981 Elmore ..... 81/490
5,450,775 A * 9/1995 Kozak ..... 81/490
5,799,552 A * 9/1998 Curtis ..... 81/490
5,868,048 A * 2/1999 Cassutti et al. ..... 81/490
5,957,014 A * 9/1999 Tseng et al. ..... 81/490
6,186,036 B1 * 2/2001 Huang ..... 81/490
6,237,451 B1 * 5/2001 Wei ..... 81/490
6,305,255 B1 * 10/2001 Wu ..... 81/439

* cited by examiner

*Primary Examiner*—James G. Smith
(74) *Attorney, Agent, or Firm*—Cherskov & Flaynik

(57) ABSTRACT

A hand tool device 10 with opposing first and second drive ends 14 and 30, and storage for multiple tool bits 24 includes a handle portion 12, concentric first and second recesses 16 and 18 in the first end 14, a tool bit base member 22 that engages the first end 14, a plurality of preselected tool bits 24 removably secured to an inner wall 26 of the tool bit base member 22, a shank 28 integrally joined to the handle portion 12 via the first end 14, a third recess 32 in the second 30, a biasing spring 34 snugly inserted into the first recess 16, and a fitting 36 removably joined to a distal end 38 of the shank 28 for removably coupling a preselected tool bit 24 to the shank 28. The tool bits 24 are removed from the tool bit base member 22 by a person forcefully separating the tool bit base member 22 from the handle portion 12 thereby expanding or biasing the spring 34 and exposing the bits 24 for removal, then extracting the required bits 24 whereupon the base member 22 is released to be ultimately returned to a closed position by the return force generated by the spring 34. The tool bits 24 are inserted into the fitting 36 or the third recess 32 or both depending upon the number of bits required to complete a project. When the work is finished, the bits 24 are returned to the base member 22.

44 Claims, 10 Drawing Sheets

HAND TOOL DEVICE WITH OPPOSING DRIVE ENDS AND STORAGE FOR MULTIPLE TOOL BITS

BACKGROUND OF THE INVENTION

1. Field of the Invention

The present invention relates to the field of hand tools and tool bits and, more particularly, to the field of hand tools that store interchangeable tool bits in or adjacent the handle.

2. Background of the Prior Art

Many hand tools provide for the use of multiple tool bits that are removably secured to the hand tool by a socket or a chuck at the tip of a shank that is integrally joined to a handle portion of the hand tool. Typically, a worker requires more than one type or size of tool bit to complete a project that includes fasteners with an assortment of drive end configurations. The worker may have to exchange bits quickly while he or she is perched in a precarious position.

This can result in the dropping of tool bits which causes inconvenience and safety problems for the worker and possible bystanders.

A convenient bit storage arrangement for hand tools positions the tool bits near or in the shank end of the handle. An ideal design is one that minimizes hand tool manufacturing costs, time for bit replacement, the chance that tool bits will be dropped, and the maneuvers a worker has to perform to complete the bit substitution; the design objectives being aimed at both safety and efficiency.

Examples of prior hand tool designs that store of tool bits include U.S. Pat. Nos. 152,228; 509,851; 516,294; 685,678; 1,904,679; 1,937,645; 3,667,518; 3,683,984; 4,235,269; 4,278,119; 4,452,289; 4,983,080; 5,174,178; 5,613,413; and 5,740,706.

Some of the designs disclosed in the above patents feature compartments in the handle to hold certain sized tool bits. However, their recessed positions in the handle renders the tool bits difficult to remove. Furthermore, these designs limit the versatility of the hand tool in that shorter tool bits would be recessed to far into their compartments for one to be able to remove the bits, and longer tool bits would require to long and clumsy a handle for storage. The problem in removing tool bits is aggravated in designs where the tool bit is held in place in the compartment through friction, snapping in place, or other such means.

Other patented designs feature storage compartments that are located at the heel of the handle as disclosed in U.S. Pat. No. 5,174,178, wherein a worker must open a hinged door to access tool bits, and U.S. Pat. No. 5,613,413, wherein a worker must unscrew a cap to access tool bits. In any event, storage in the heel of the handle requires flipping the tool back and forth when interchanging tool bits as the worker first removes the bit from the tip of the shank, then reaches to the back of the handle for a replacement bit, stores away the tool bit no longer required, and finally reaches back to the tip of the shank to install the new bit at the tip.

There are still further designs where the tool bits are stored in the handle near to and parallel to the shaft, but with their tips protruding from the handle as disclosed in U.S. Pat. No. 4,452,289. The disadvantages of this tool are that the tips are exposed and may scratch the user of the tool or adjacent objects, and that the metal tool bits may initiate an electrical arc near the user's hand causing injury or the dropping of the tool.

U.S. Pat. No. 4,278,119 illustrates an alternative design to having the tool bits protruding from the handle. This patent secures the bits to a slidable end portion of the handle and biases the end portion into the handle via an external spring. The problem with this design is that the external spring may become entangled with adjacent objects. Another problem with this and the aforementioned designs is that only one end of the handle is utilized for positioning tool bits.

Using both ends of a handle for removably securing tool bits thereto, would allow the user to engage two distinct fasteners by merely repositioning the handle in his or her hand.

There is a need in the art for a hand tool wherein tool bits are stored by means that would accommodate a wide variety of tool bits, minimize the manual steps required to interchange and store tool bits, and limit the exposure of the bits to adjacent objects. One design would store the bits inside an end portion of the handle and include an internal spring to bias an end cover toward the portion of the handle receiving the tool bits. The design would include the use of both ends of the handle to removably receive and rotate tool bits that would engage different types of fasteners. Another design would store the tool bits in a cylindrical, transparent enclosure that includes an internal spring to bias the enclosure and the tool handle together. The enclosure would provide access to a selected tool bit via an aperture in a cylindrical side wall of the enclosure.

SUMMARY OF THE INVENTION

An object of the present invention is to provide a tool that stores tool bits and that overcomes the disadvantages of the prior art.

A principle object of the present invention is to store multiple tool bits in the handle of the tool. A feature of the tool is a cavity in an end portion of the handle of the tool. An advantage of the tool is that the tool bits are prevented from engaging objects adjacent to the tool.

Another object of the present invention is to secure multiple tool bits in an end portion of the handle. A feature of the tool is an end cover that has recesses in an inner wall that snugly receive tool bits. An advantage of the tool is that the position of the tool bits is maintained irrespective of the orientation of the hand tool.

Yet another object of the present invention is to provide a biasing member that is maintained inside the tool handle. A feature of the tool is a spring position upon a shank and having opposing ends secured to an inner portion of the handle and to the end cover. An advantage of the device is that the end cover and the handle are biased together and the spring cannot engage objects adjacent to the handle.

Still another object of the present invention is to provide a tool capable of removably receiving and rotating two tool bits. A feature of the tool is bit receiving recesses positioned in opposing ends of the tool handle. An advantage of the tool is that two different sizes or types of fasteners can be forcibly driven without removing and replacing one tool bit for another.

Another object of the present invention is to provide a tool having a transparent tool bit enclosure for storing multiple tool bits. A feature of the tool is a cylinder with recesses that snugly receive predetermined tool bits. An advantage of the tool is that the position of the tool bits is maintained irrespective of the orientation of the tool.

A further object of the present invention is to provide a member that biases the enclosure and the handle together. A feature of the tool is a biasing spring positioned upon the shank and having opposing ends secured to an inner portion of the handle and the cylinder. An advantage of the tool is that the tool bits may removed from the cylinder via an open top portion of the enclosure upon the forcible separation of the enclosure from the handle.

Still another object of the present invention is to provide access to any one of the tool bits in the enclosure without separating the enclosure from the handle. A feature of the tool is an aperture in a cylindrical wall of the enclosure. Another feature of the tool is a cylindrical wall that is rotatable in relation to the cylinder. An advantage of the tool is that any one of the tool bits secured by the cylinder may be removed from the enclosure without separating the enclosure from the handle by rotating the cylindrical wall such that the aperture is adjacent to the selected tool bit.

Another object of the present invention is to provide access to any of the tool bits in the enclosure without separating the enclosure from the handle. A feature of the tool is multiple apertures in the cylindrical wall of the enclosure. An advantage of the tool is that any of the tool bits secured by the cylinder may be removed from the enclosure without separating the enclosure from the handle and without rotating the cylindrical wall.

Another object of the present invention is to provide a removable handle end that removably receives a tool bit. A feature of the tool is a relatively small configuration that allows the tool bit in the handle end to insert unobtrusively into the handle opposite the shank. An advantage of the tool is that two separate "drive" tools are included in one handle.

Briefly, the invention provides a hand tool device having opposing drive ends and storage for multiple tool bits comprising a handle portion, a shank integrally joined to said handle portion, a first end having first and second recesses longitudinally aligned with the central axis of said handle portion, a second end having a third recess longitudinally aligned with the central axis of said handle portion, said third recess of said second end being configured to removably receive a preselected tool bit therein, a tool bit base member having a central aperture that snugly receives said shank therethrough, a plurality of tool bits removably secured to an inner wall of said tool bit base member, said second recess being configured to cooperate with said tool bit base member so as to receive said plurality of tool bits therein, means for biasing said tool bit base member into cooperative engagement with said second end of said device, means for removably securing said plurality of tool bits to said inner wall of said tool bit base member, and means for coupling any one of said plurality of tool bits to a distal end of said shank.

BRIEF DESCRIPTION OF THE DRAWINGS

The foregoing invention and its advantages may be readily appreciated from the following detailed description of the preferred embodiment, when real in conjunction with the accompanying drawings in which.

DESCRIPTION OF THE PREFERRED EMBODIMENT

Figure 1:
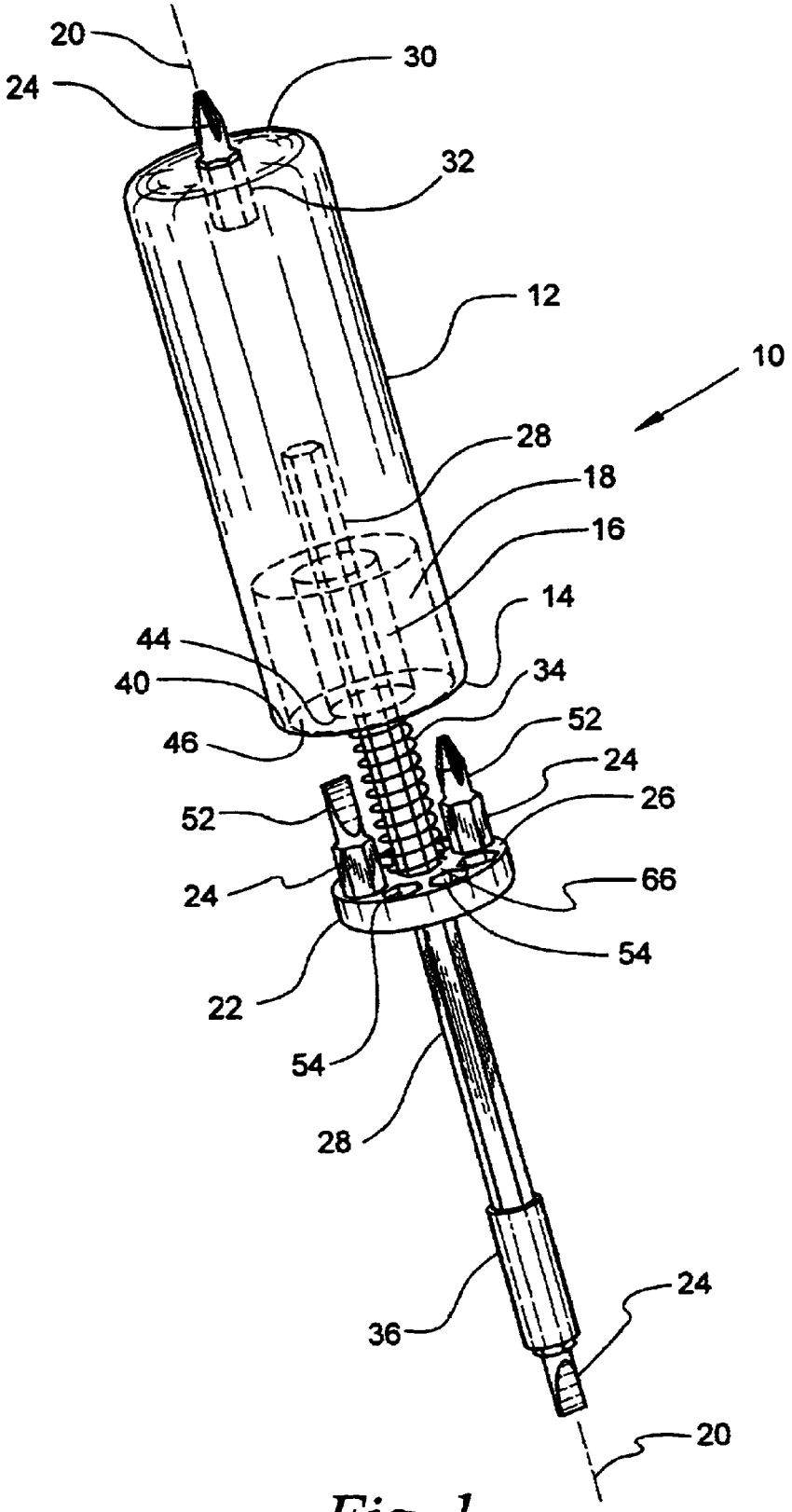
FIG. 1 is a perspective view of a hand tool device having opposing drive ends and storage for multiple tool bits in an "open" position in accordance with the present invention.
Figure 2:
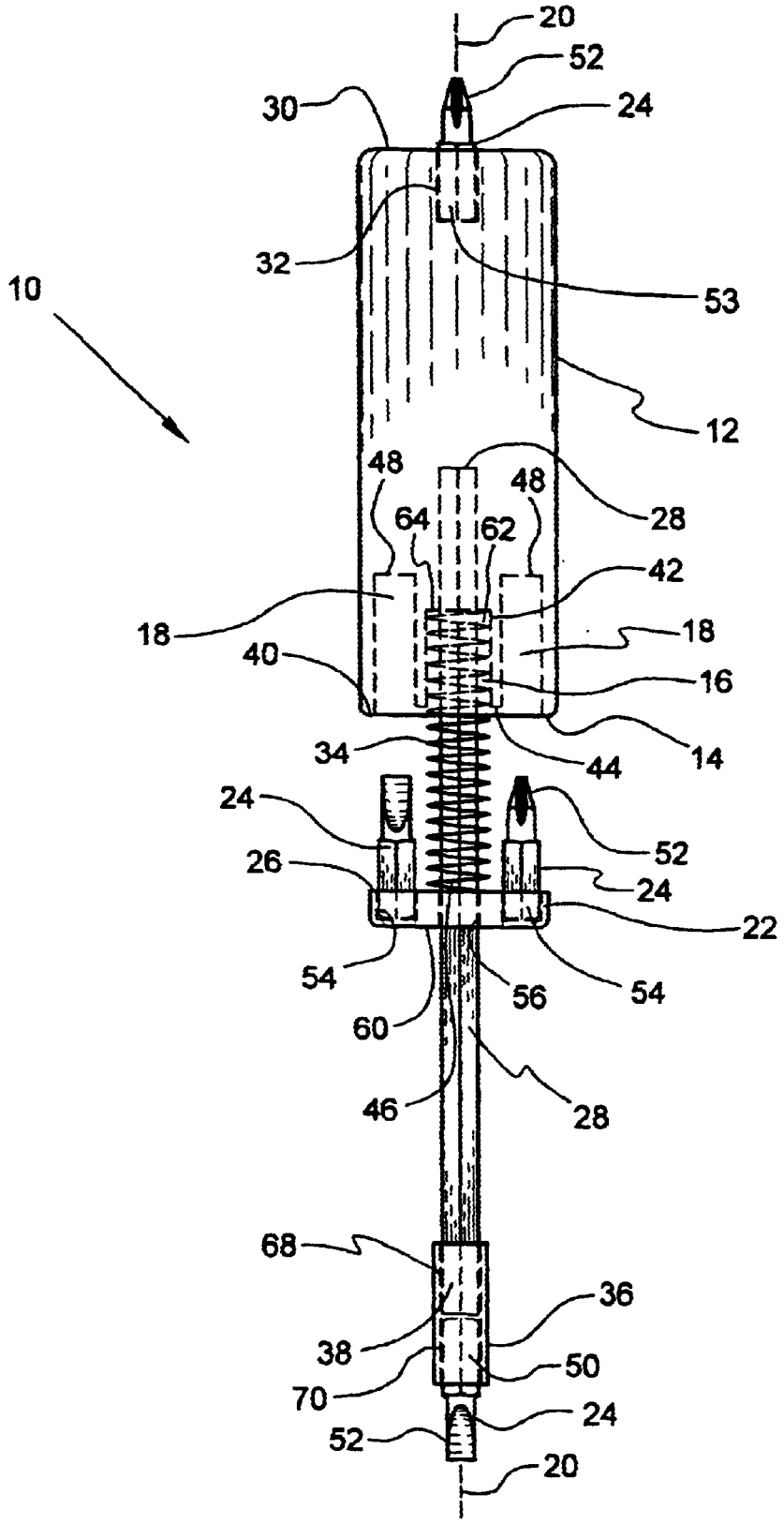
FIG. 2 is a front elevation view of the hand tool device depicted in FIG. 1.

Referring now to the drawings and in particular to FIGS. 1 and 2, perspective and front elevation views of a hand tool device having opposing drive ends and storage for multiple tool bits in accordance with the present invention, is denoted by numeral 10. The hand tool device 10 includes a handle portion 12 fabricated from plastic or other well known materials, a first end 14 having concentric first and second recesses 16 and 18 longitudinally aligned with the central axis 20 of the handle portion 12, a plastic tool bit base member 22 that engages the first end 14, a plurality of preselected tool bits 24 removably secured to an inner wall 26 of the tool bit base member 22, a shank 28 integrally joined to the handle portion 12 via the first end 14, a second end 30 having a third recess 32 longitudinally aligned with the central axis 20 of the handle portion 12, a metal biasing spring 34 snugly inserted into the first recess 16, and a metal fitting 36 removably joined to a distal end 38 of the shank 28 for removably coupling a preselected tool bit 24 to the shank 28.

Figure 3:
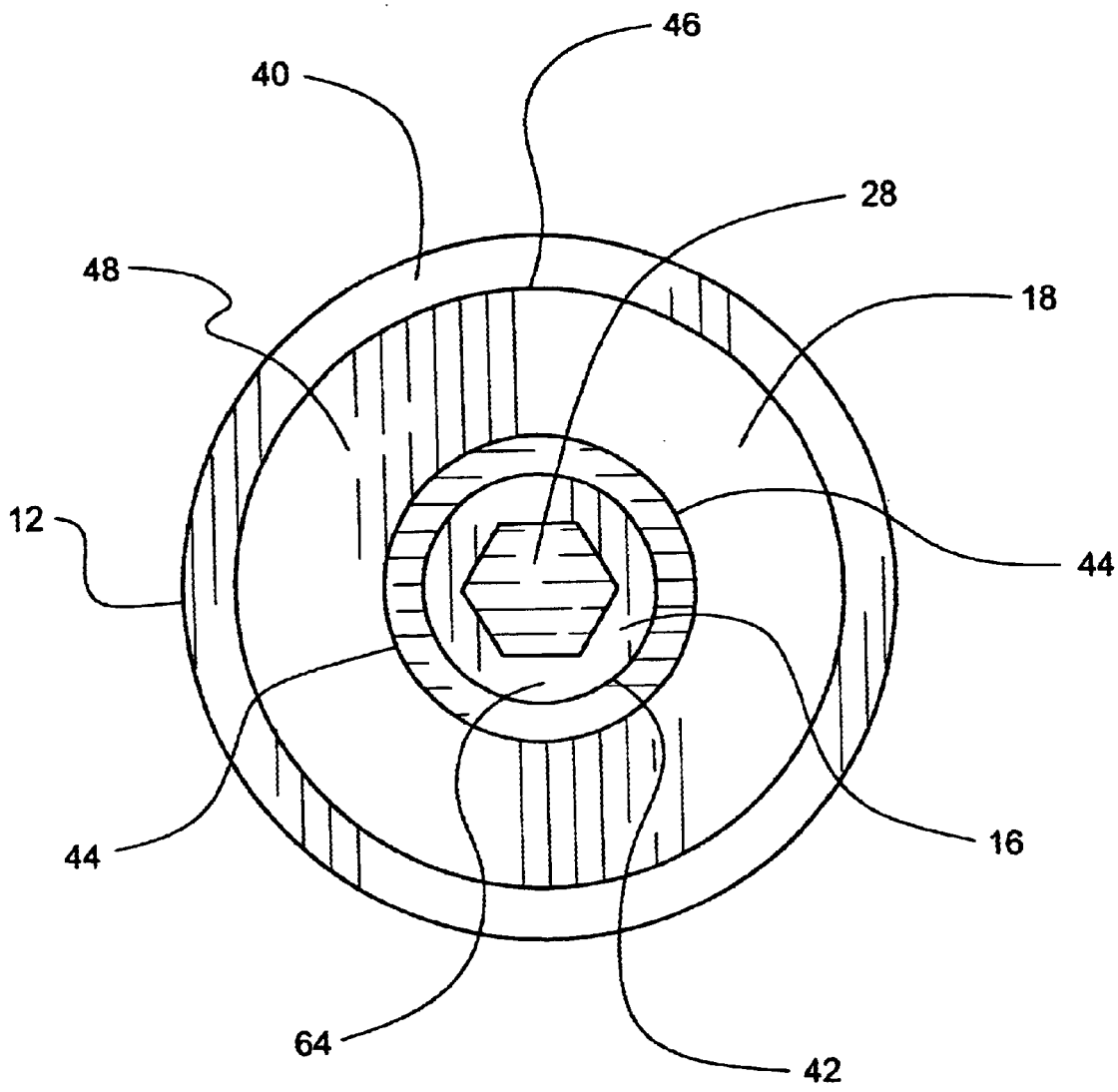
FIG. 3 is an elevation view of the first end of the hand tool device with the stored tool bits and biasing spring removed.
Figure 4:
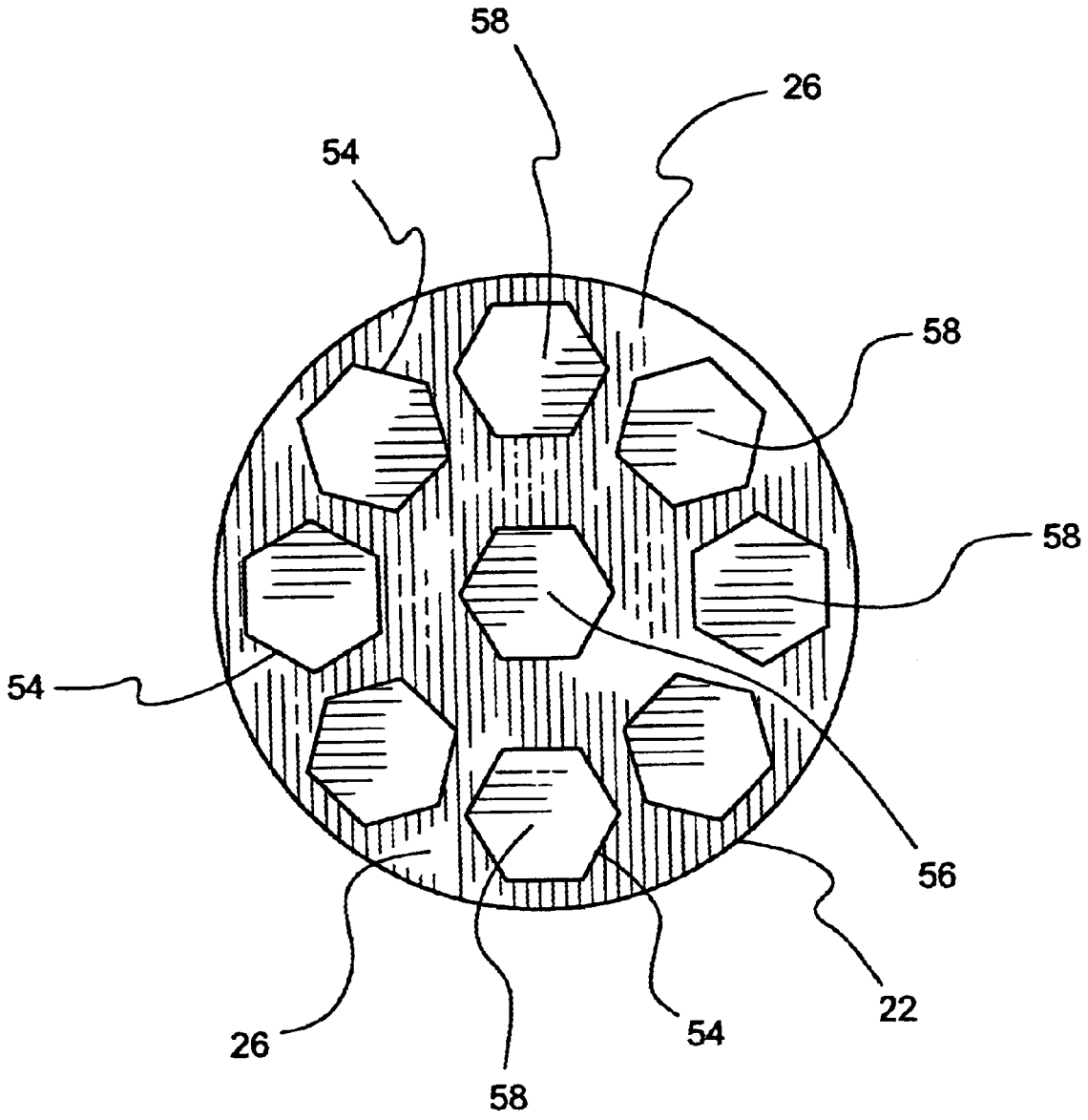
FIG. 4 is an elevation view of the inner wall of the tool bit base member with the stored tool bits removed.

Referring to FIGS. 1–3, the handle portion 12 has a substantially cylindrical configuration, when taking an end view of the device 10, with longitudinal and diameter dimensions that promote the transfer of rotary motion from a user's hand to the device 10. The first end 14 includes a cylindrical rim 40 having a dimension that results from the outer diameter of the second recess 18. The cylindrical rim 40 ultimately engages a peripheral portion of the inner wall 26 of the tool bit base member 22 when the device 10 is in a non-biased or closed position. The first recess 16 has a cylindrical wall 42 axially aligned with the central axis 20. The wall 42 extends longitudinally a distance substantially the same as the longitudinal dimension of the spring 34 when in a non-biased position. The shank 28 is axially aligned with the first recess 16 and inserts into the handle portion 12 a depth substantially greater than the longitudinal dimension of the first recess 16. The second recess 18 is formed from inner and outer cylindrical walls 44 and 46 coaxially aligned with the first recess 16 and extending a longitudinal distance to form a bottom wall 48 sufficiently removed from the first end 14 to allow the preselected tool bits 24 to be unobtrusively inserted into the second recess 18 when the rim 40 engages the inner wall 26 of the base member 22.

The third recess 32 in the second end 30 of the handle portion 12 is axially aligned with the shank 28 and extends longitudinally a relatively short distance from the second end 30. The third recess 32 is hexagonally configured (although other configurations may be utilized), when taking a second end 30 view, and dimensioned to snugly receive a correspondingly configured insertion portion 50 of any one of the preselected tool bits 24 such that a fastener engagement end 52 of the tool bit 24 is sufficiently exposed to engage a preselected fastener.

Referring to FIGS. 1–4, the tool bit base member 22 includes a plurality of recesses 54 circumferentially positioned around a central aperture 56 that snugly receives the shank 28. The recesses 54 extend from the inner wall 26 of the base member 22 to a planar inner or bottom wall 58 that is located proximate to an outer planar wall 60 of the base member 22. The recesses 54 are configured to expand slightly to snugly receive the tool bits 24 such that an operator must forcefully insert or remove the bits 24 from the recesses 54, thus the position of each bit 24 is maintained irrespective of the orientation of the device 10. The shank 28 and central aperture 56 are hexagonally configured, when taking a first end view of the device 10, and cooperated to allow the base member 22 to slide longitudinally upon the periphery of the shank 28 toward and away from the handle portion 12, yet prevent the base member 22 from rotating radially around the perimeter of the shank 28. The recesses 54 are configured and dimensioned to removably receive the insertion portion 50 of one of the plurality tool bits 24 such that each tool bit 24 is maintained longitudinally parallel to the central axis of the hand tool 10 irrespective of the orientation of the hand tool device 10.

The biasing spring 34 must have a sufficient bias force to return the spring 34 and the attached tool bit base member 22 to an original position after being stretched a distance that allows the tool bits 24 to be removed from the tool bit base member 22. The biasing spring 34 has a first end 62 secured to an inner or end wall 64 of the first recess 16, and a second end 66 secured to the inner wall 26 of the tool bit base member 22. The spring 34 is configured to longitudinally receive the shank 28 therethrough. The spring 34 snugly inserts into the first recess 16 such that the spring 34 and recess 16 are longitudinally aligned with the third recess 32 of the second end 30 thereby axially aligning the shank 28, spring 34 and the third recess 32. The spring 34 is enclosed in the first recess 16 by the tool bit base member 22 when the spring 34 is in a non-biased or "normal" position. The spring 34 is exposed upon the shank 28 when the spring 34 is in a biased or "stretched" position. Thus, the spring 34 promotes engagement between the tool bit base member 22 and the first end 14 of the hand tool device when an operator forcefully disengages the tool bit base member 22 from the first end 14 to obtain a tool bit stored in the second recess 18.

The fitting 36 includes opposing longitudinally aligned first and second recesses 68 and 70. The first recess 68 is configured and dimensioned to snugly receive the distal end 38 of the shank 28. The second recess 70 is configured and dimensioned to snugly receive the insertion portion 50 of one of the plurality of tool bits 24 forcibly removed from the tool bit base member 22.

In operation, a user with one hand grasps the device 10 by the handle portion 12, then with the other hand forcibly disengages the tool bit base member 22 from the first end 14 of the device 10 thereby stretching the biasing spring 34 upon the shank 28. The return force generated by the spring 34 allows the user to maintain the position of the base member 22 with one hand while the user forcibly inserts one or more preselected tool bits 24 into the recesses 58 of the tool bit base member 22. Upon completing the tool bit 24 installation, the user allows the biasing spring 34 to urge the base member 22 into engagement with the cylindrical rim 40 of the first end 14 of the device 10. When the user requires a particular tool bit 24, he or she need only extend the base member 22 to obtain the tool bit 24, allow the member 22 to be repositioned upon the first end 14 by the return force of the spring 34, then insert the selected tool bit in the second recess 70 of the fitting 36 to ultimately tighten or loosen a fastener.

Figure 5:
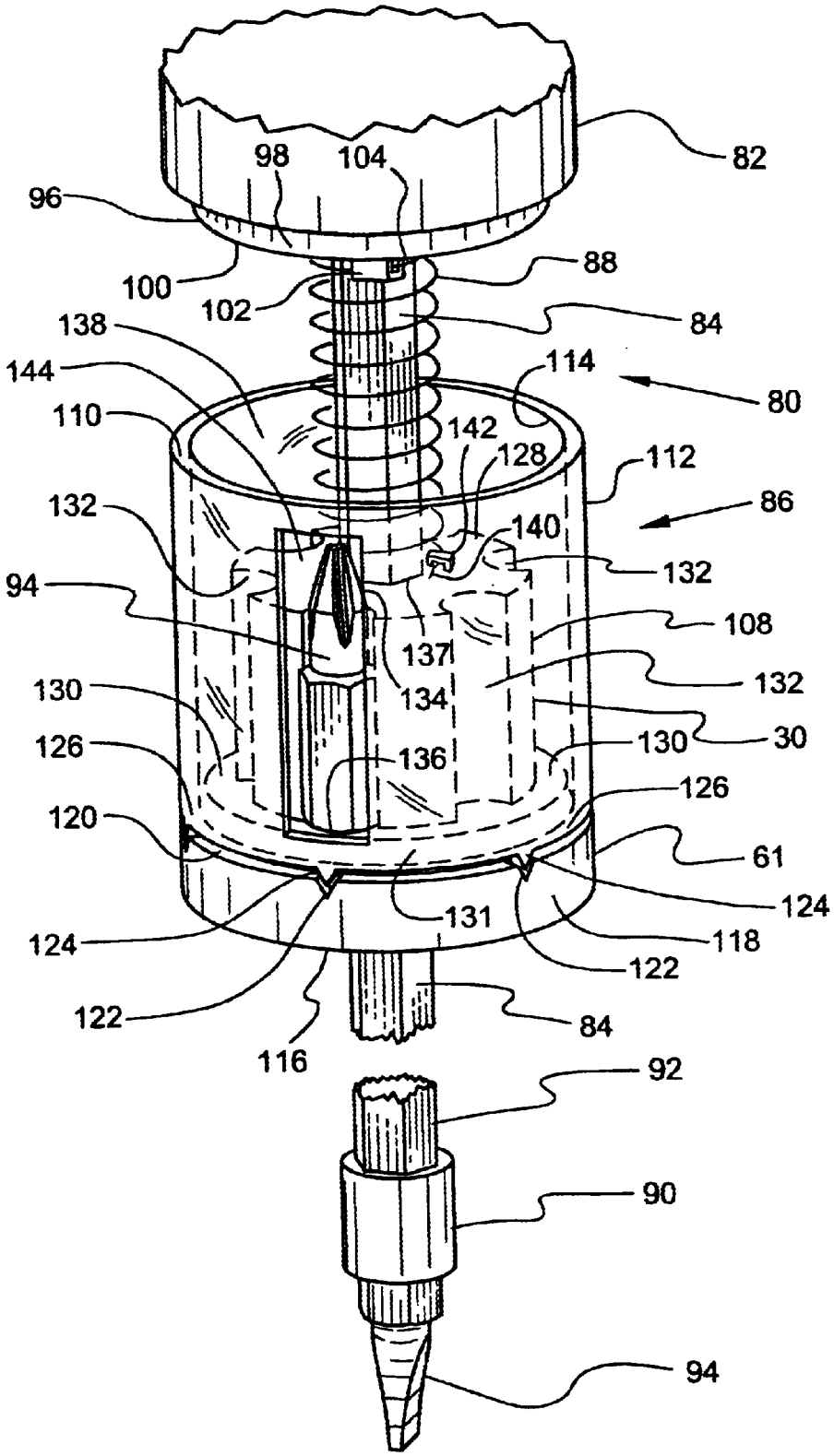
FIG. 5 is perspective view of an alternate embodiment of the hand tool device in accordance with the present invention.
Figure 6:
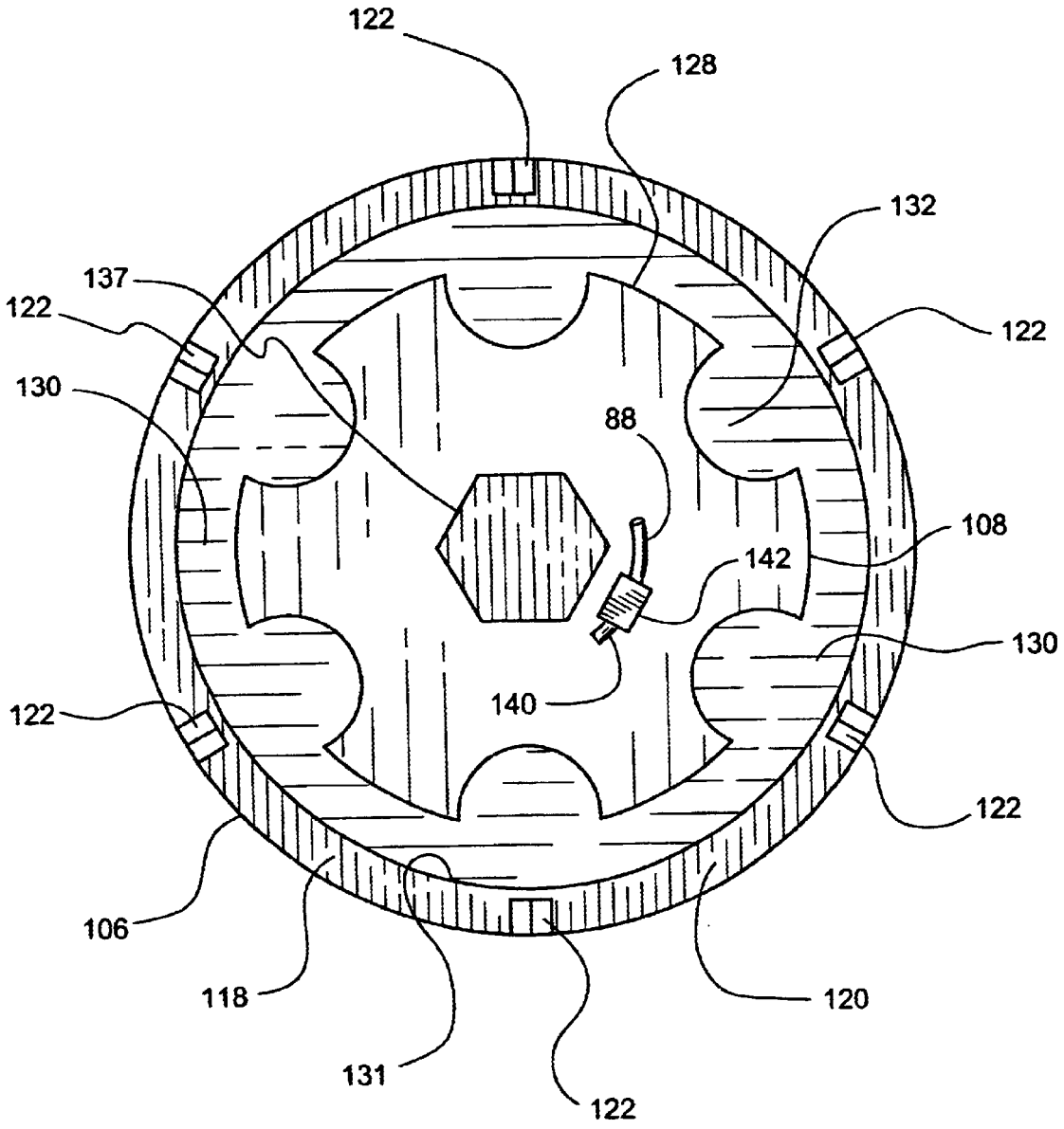
FIG. 6 is a top elevation view of a tool bit enclosure member of the hand tool depicted in FIG. 5.

Referring now to FIGS. 5 and 6, perspective and top views of an alternate embodiment of a hand tool and tool bit dispenser device in accordance with the present invention, is denoted by numeral 80. The alternate device 80 includes a handle 82, a shank 84 removably or integrally joined to the handle 82, a tool bit enclosure 86 removably received upon the shank 84, a biasing spring 88 removably secured to the handle 82 and enclosure 86, a fitting 90 removably secured to a distal end 92 of the shank 84, and a plurality of tool bits 94 detachably joined to the tool bit enclosure 86. The handle 82 includes a cylindrically configured enclosure engagement member 96 having diameter and axial dimensions that allows the member 96 to snugly insert into the enclosure 86 a distance that provides stability to the separably joined handle 82 and enclosure 86 assembly. The member 96 has a cylindrical side wall 98 and a planar end wall 100, the end wall 100 having an elevated spring retainer eyelet 102 that removably receives a first end 104 of the biasing spring 88.

The tool bit enclosure 86 includes a base portion 106 integrally joined to a cylinder portion 108, and a transparent, rotatable bit access member 110 having an outer cylindrical wall 112 with a diameter substantially the same as the handle 82 diameter, and an inner cylindrical wall 114 with a diameter dimensioned to cooperate with the diameter of the end wall 100 of the engagement member 96 to promote snug engagement between the bit access member 110 and the engagement member 96. The base portion 106 has an outer planar end wall 116, a cylindrical side wall 118, and a planar, inner cylindrical rim portion 120 that extends from the side wall 118 to the cylinder portion 108. The rim 120 includes a plurality of "V" notches 122 that are configured to congruently and removably receive corresponding "V" protrusions 124 extending from a first end 126 of the cylindrical access member 110. When the protrusions 124 are placed in the notches 122, the first end 126 of the access member 110 engages the rim portion 120 of the base portion 106. The cylinder portion 108 includes top and bottom end walls 128 and 130, a cylindrical side wall 131 extending perpendicularly between the rim portion 120 and the bottom wall end 130, and a plurality of tool bit recesses 132.

The tool bit recesses 132 are dimensioned to removably receive the tool bits 94 such that a fastener engagement end 134 of the bits 94 extends above the top wall 128 of the cylinder portion 108 when an end wall 136 of the bit 94 engages the bottom wall 130 of the cylinder portion 108. Further, the recesses 132 are configured such that the tool bits 94 must forcefully be removed by a person operating the hand tool by prying the bit 94 from the recess 132 via the fastener engagement end 134. Thus, the tool bits 94 are maintained in the recesses 132 irrespective of the orientation of the hand tool 80 or the rotational forces impressed upon the handle 82 by the user. The diameter of the bottom wall 130 of the cylinder portion 108 provides sufficient separation between the cylindrical side wall 131 and the inner wall 114 of the access member 110 to allow the access member 110 to be manual rotated upon the base portion 106. An aperture 137 is centrally positioned through the integrally joined base and cylinder portions 106 and 108, and configured to snugly receive the shank 84 therethough to allow the base and cylinder portions 106 and 108 to "slide" upon the surface of the shank 84, thus allowing an user of the hand tool 80 to gain access to the tool bits 94 via a top opening 138 in the access member 110 by forcefully separating the access member 110 from the handle 82. The biasing spring 88 has a second end 140 removably attached to a raised eyelet 142 on the top end wall 128 of the cylinder portion 108 thereby securing the biasing spring 88 between the handle 82 and the cylinder portion 108 to provide a return force that repositions the access member 110 into engagement with the handle 82.

The access member 110 includes an aperture 144 that allows access to a preselected tool bit 94 by rotating the member 110 until the aperture 144 is positioned adjacent to the preselected tool bit 94 and the access member 10 is "locked" in position by the protrusions 124 engaging the notches 122. The protrusions 124 and notches 122 are equal in number and total a quantity sufficient to position the aperture 144 adjacent to any tool bit 94 secured to the cylinder 108. The aperture 144 is dimensioned to allow a person to insert one finger through the aperture 144 and grasp the fastener engagement end 134 of the bit 94, then pry the bit 94 from the cylinder 108 and though the aperture 144 until completely separating the bit 94 from the cylinder 108. The aperture 144 allows a person to remove tool bits 94 from the enclosure 86 without separating the enclosure 86 from the handle 82 to gain access to the tool bits 94 via the opening 138 in the top of the enclosure 86. The aperture 144 reduces the time and the steps required for a person to remove a bit 94 from the enclosure 86.

Figure 7:
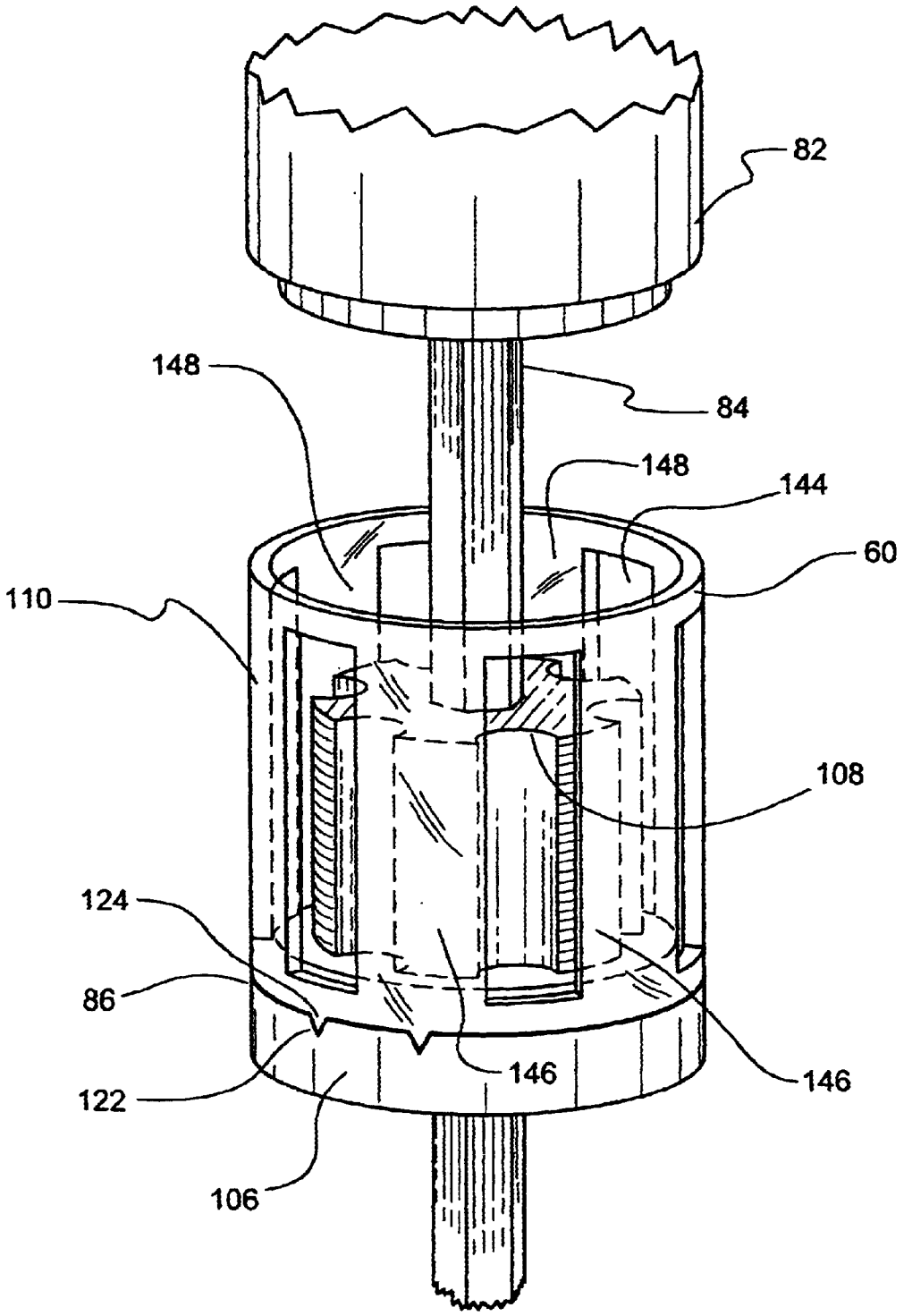
FIG. 7 is a perspective view of device of FIG. 5 but with a plurality of apertures in the tool bit enclosure portion.

Referring now to FIG. 7, an alternative embodiment of the access member 110 is depicted. Instead of only one aperture 144, the access member 110 now includes a plurality of apertures 144 that are circumferentially positioned around the access member 110 such that an aperture 144 is adjacent to each tool bit 94 in the cylinder 108 thereby allowing a person to remove one or all the tool bits 94 from the enclosure 86 without rotating the access member 110. After removing the required bits 94, the access member 110 is rotated "one notch" to position the apertures 144 adjacent to an arcuate portion 146 of the cylinder 108 thereby "covering" the bits 94 with sections 148 of the access member 110 between the apertures 144.

Figure 8:
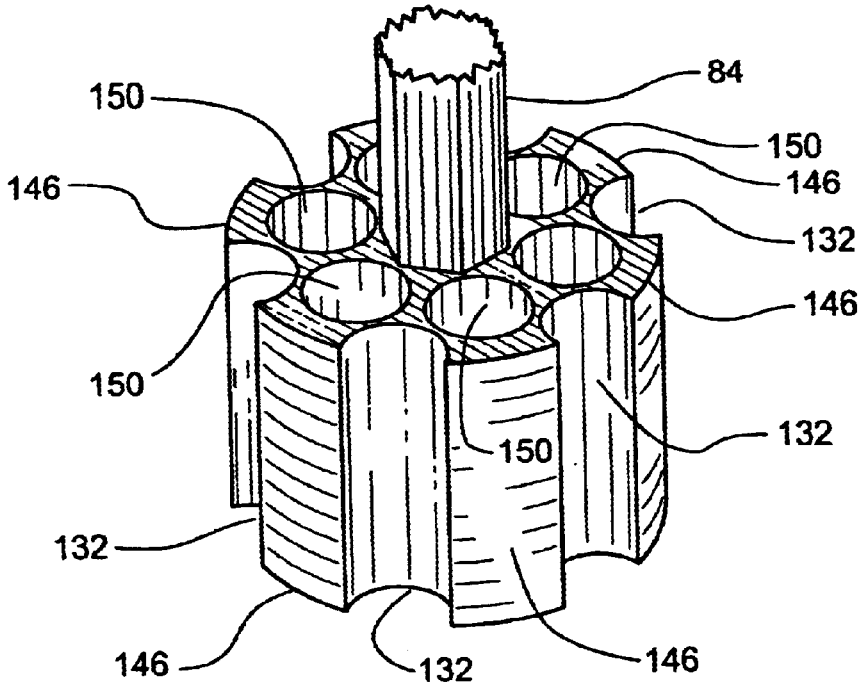
FIG. 8 is a perspective view of an alternative design of a cylinder portion of the tool bit enclosure member of the hand tool depicted in FIG. 5.
Figure 9:
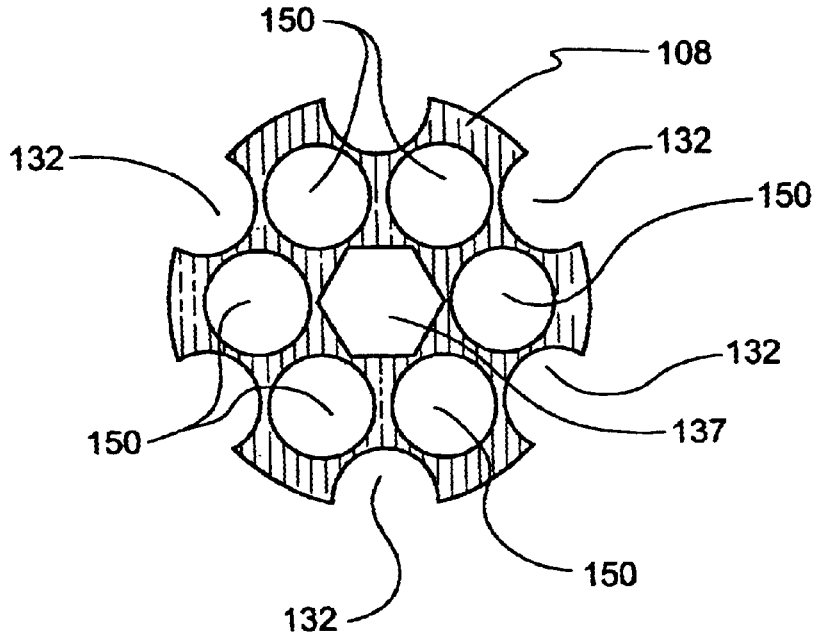
FIG. 9 is a top elevation view of the cylinder portion depicted in FIG. 8, but with the shank removed.
Figure 10:
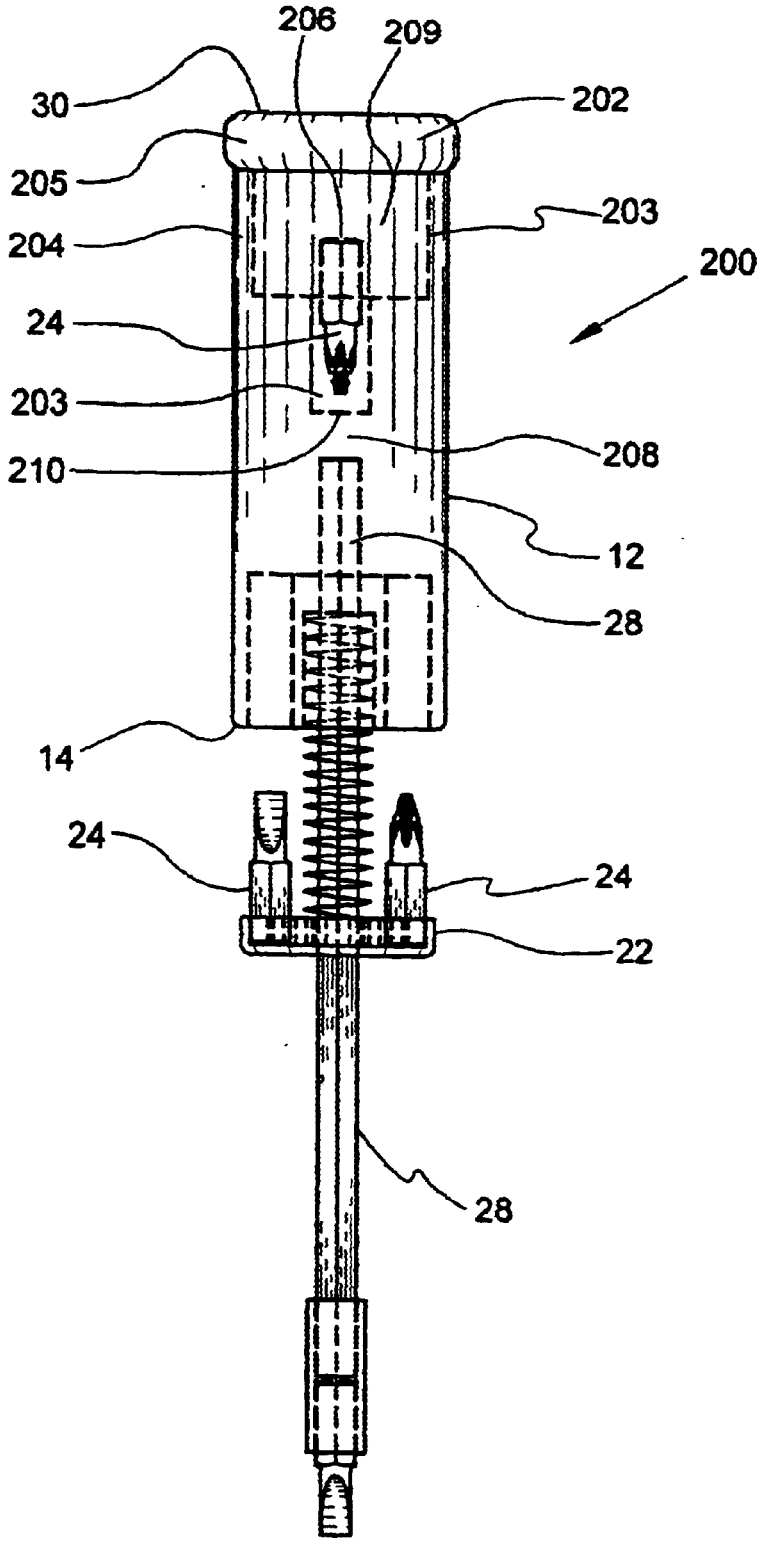
FIG. 10 is a side elevation view of an alternate embodiment of the hand tool of FIG. 1, the alternate embodiment including a detachable "driver" tool inserted in an end of the handle opposite the shank.
Figure 11:
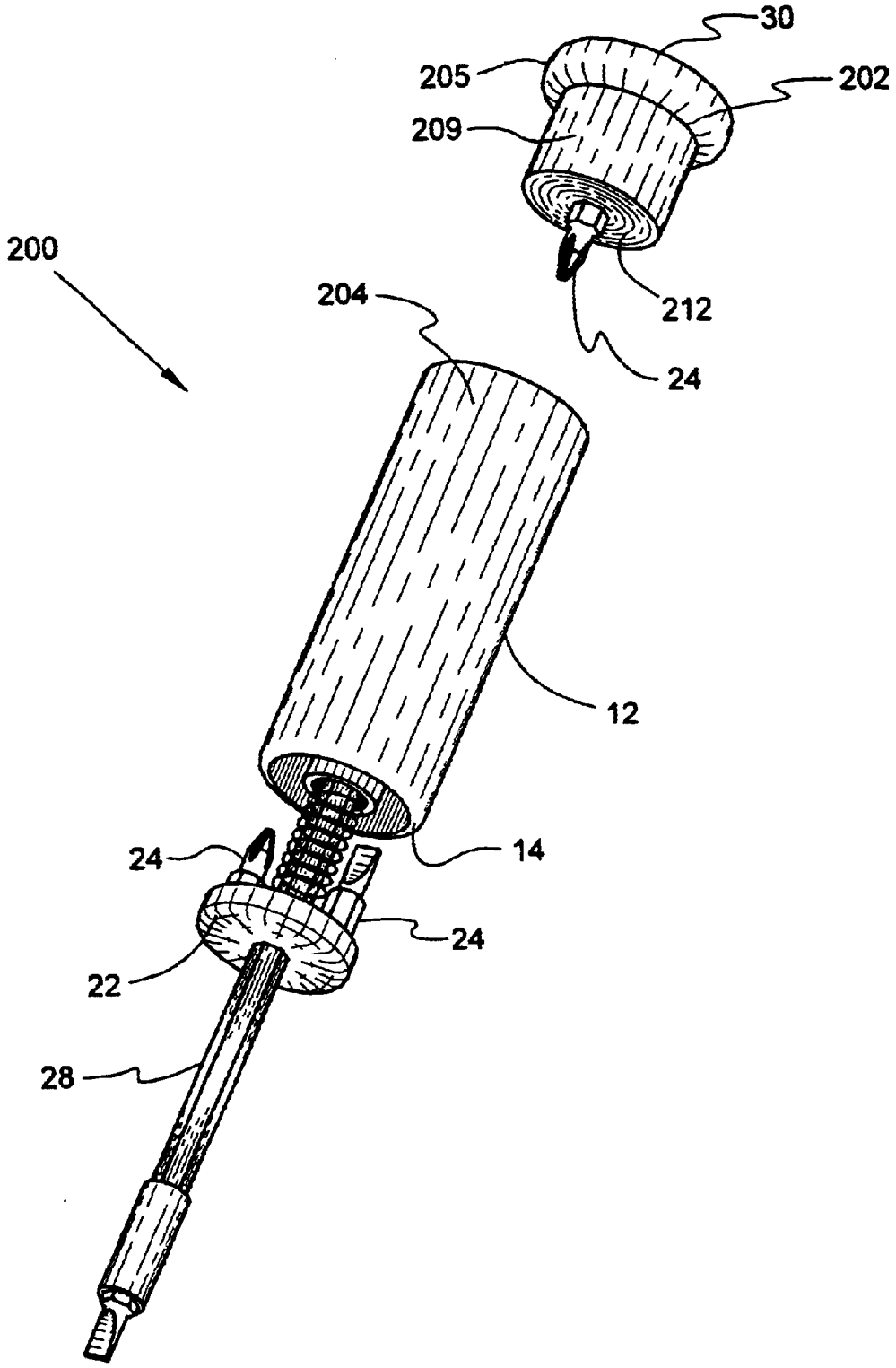
FIG. 11 is a perspective view of the alternate embodiment of FIG. 10 with the detachable driver tool separated from the end of the handle.

Referring now to FIGS. 8 and 9, perspective and top views of an alternative embodiment of the cylinder portion 108 are depicted. To increase the number of tool bits 94 that may be held by the cylinder portion 108, a plurality of tool bit apertures or chambers 150 have been added circumferentially around the central aperture 137 such that the central axes of the tool bit apertures 150 are parallel with the central axis of the central aperture 137. The central axes of the tool bit apertures are radially aligned with a longitudinal centerline of an adjacent arcuate portion 146 of the cylinder 108, and radially offset from each longitudinal centerline of two adjacent tool bit recesses 132.

Referring now to drawings 10 and 11, an alternate embodiment of the hand tool of FIG. 1 is depicted and denoted as numeral 200. The embodiment includes a cylindrically configured second "driver" tool 202 that snugly and removably inserts into a cooperating cavity 203 in an end portion 204 of the handle 12 opposite the shank 28. The second driver tool 202 includes a hand grip 205 and an insertion portion 209 having an axially disposed recess 206 in a planar, annular configured inner wall 212. The recess 206 removably receives one of the several available tool bits 24 from the tool bit base member 22. The cavity 203 is configured to receive the second driver tool 202 with an inserted tool bit 24. A relatively small handle portion 208 longitudinally separates the shank 28 from a bottom wall 210 of the cavity 203 to maintain the structural integrity of the handle 12 as an operator imparts axial and rotational force upon the handle 12. The dimensions of the handle portion 208 required to withstand these imparted forces are well known to those of ordinary skill in the art. The positioning of a second drive tool 202 in a second end 30 of the tool 200 such that the tool bit 24 projects into the handle 12, provides an alternatively sized drive tool without the delay of substituting tool bits 24 and without the risk of a hand injury to the operator due to protruding tool bits 24 at each end 14 and 30 of the handle 12.

While the invention has been described in the foregoing with reference to details of the illustrated embodiment, these details are not intended to limit the scope of the invention as defined in the appended claims.

What is claimed is:

1. A hand tool device having opposing drive ends and storage for multiple tool bits comprising:

a handle portion;

a shank integrally joined to said handle portion;

a first end of said handle portion having first and second recesses longitudinally aligned with the central axis of said handle portion;

a second end of said handle portion having a third recess longitudinally aligned with the central axis of said handle portion, said third recess of said second end being configured to removably receive a preselected tool lit therein;

a tool bit base member having a central aperture that snugly receives said shank therethrough;

a plurality of tool bits removably secured to an inner wall of said tool bit base member, said second recess being configured to cooperate with said tool bit base member so as to receive said plurality of tool bits therein;

means for biasing said tool bit base member into cooperative engagement with said first end of said handle portion, said biasing means includes a spring snugly inserted in said first recess, said first recess and said spring being longitudinally aligned with said third recess of said second end of said handle portion thereby axially aligning said shank, spring and third recess;

means for removably securing said plurality of tool bits to said inner wall of said tool bit base member; and means for coupling any one to said plurality of tool bits to a distal end of said shank.

2. The device of claim 1 wherein said first and second recesses are cylindrically configured when taking a first end view of said hand tool device.

3. The device of claim 1 wherein said third recess is hexagonally configured when taking a second end view of said hand tool device.

4. The device of claim 1 wherein said spring is enclosed in said first recess in said first end of said handle portion by said tool bit base member when said spring is in a non-biased position.

5. The device of claim 1 wherein said spring is exposed upon said shank when said spring is in a biased position, said spring having a first end secured to an end wall in said first recess, and a second end secured to said tool bit base member thereby promoting engagement between said tool bit base member and said first end of said handle portion when an individual forcefully disengages said bit base member from said first end of said handle portion to obtain a tool bit stored in said second recess.

6. The device of claim 1 wherein said inner wall of said tool bit base member includes a plurality of recesses circumferentially positioned around said central aperture, said recesses being configured to removably receive said plurality of tool bits such that said tool bits are maintained longitudinally parallel to the central axis of said hand tool irrespective of the orientation of said hand tool device.

7. The device of claim 1 wherein said coupling means includes a fitting having opposing longitudinally aligned recesses.

8. The device of claim 7 wherein said opposing recesses are configured to snugly receive said shank and one of said plurality of tool bits.

9. A hand tool device having opposing drive ends and storage for multiple tool bits comprising:

a handle portion;

a shank integrally joined to said handle portion;

a first end having first and second recesses longitudinally aligned with the central axis of said handle portion, said second recess includes an inner cylindrical wall adjacent to said first recess of said first end of said hand portion, and an outer cylindrical wall adjacent to an outer wall of said handle portion, said inner and outer wall being axially aligned with the central axis of said hand tool;

a second end having a third recess longitudinally aligned with the central axis of said handle portion, said third recess of said second end being configured to removably receive a preselected tool bit therein;

a tool bit base member having a central aperture that snugly receives said shank therethrough;

a plurality of tool bits removably secured to an inner wall of said tool bit base member, said second recess being configured to cooperate with said tool bit base member so as to receive said plurality of tool bits therein;

means for biasing said tool bit base member into cooperative engagement with said first end of said device;

means for removably securing said plurality of tool bits to said inner wall of said tool bit base member; and means for coupling any one of said plurality of tool bits to a distal end of said shank.

10. The device of claim 9 wherein said inner cylindrical wall includes a diameter relatively larger than the diameter of said first recess.

11. The device of claim 9 wherein said outer cylindrical wall includes a diameter relatively larger than the diameter of said inner cylindrical wall.

12. The device of claim 9 wherein said inner and outer cylindrical walls include an axial dimension that is relatively longer than the axial dimension of said first recess, and relatively shorter than an insertion dimension said shank into said handle portion.

13. A hand tool and tool bit dispenser device comprising:

a handle;

a shank removably joined to said handle;

a tool bit enclosure removably received upon said shank;

means for promoting engagement between said handle and said tool bit enclosure;

means for biasing said enclosure into cooperative engagement with said handle, said biasing means includes a spring having a first end secured to an end wall of said handle and a second end secured to an end wall of said tool bit enclosure, said spring being configured to longitudinally receive said shank therethrough;

means for securing preselected tool bits to said tool bit enclosure; and means for coupling any one of said preselected tool bits to a distal end of said shank.

14. The device of claim 13 wherein said tool bit enclosure includes a cylinder having a plurality of recesses, each of said recesses removably receiving a tool bit therein, said cylinder further including a central aperture to snugly receive said shank therethough.

15. The device of claim 14 wherein said enclosure includes a cylindrical periphery having a plurality of apertures that cooperate with said plurality of recesses of said cylinder to allow a preselected tool bit to be removed from a corresponding recess while said enclosure is in a non-biased position.

16. The device of claim 13 wherein said enclosure includes an open top portion that promotes access to said tool bit when said enclosure is in a biased position.

17. The device of claim 13 wherein said tool bit enclosure includes a cylinder having a plurality of chambers, each of said chambers removably receiving a tool bit therein, said cylinder further including a central aperture to snugly receive said shank therethough.

18. The device of claim 17 wherein said tool bits are accessed via an open top portion in said enclosure when said enclosure is in a biased position.

19. The device of claim 13 wherein said tool bit enclosure includes a cylinder having a plurality of recesses and a plurality of corresponding chambers, each of said recesses and said chambers removably receiving a tool bit therein, said cylinder further including a central aperture to snugly receive said shank therethough.

20. The device of claim 15 wherein said cylindrical periphery is transparent.

21. The device of claim 13 wherein said securing means includes forcefully inserting said tool bits into a portion of said tool bit enclosure.

22. The device of claim 13 wherein said securing means includes maintaining said tool bits in a portion of said tool bit enclosure.

23. The device of claim 13 wherein said coupling means includes a fitting having opposing longitudinally aligned recesses.

24. The device of claim 14 herein said tool bit enclosure includes a cylindrical periphery with one aperture that cooperates with a selected recess of said cylinder to allow access to a tool bit in said selected recess while said enclosure is in a non-biased position.

25. A hand tool and tool bit dispenser device comprising:

a handle;

a shank removably joined to said handle;

a tool bit enclosure removably received upon said shank, said tool bit enclosure includes a cylinder having a plurality of recesses, each of said recesses removably receiving a tool bit therein, said cylinder further including a central aperture to snugly receive said shank therethrough, said tool bit enclosure further including a cylindrical periphery with one aperture that cooperates with one of said plurality of recesses of said cylinder to allow access to a tool bit in said selected recess while said enclosure is in a non-biased position, said cylindrical periphery being rotatable upon a bade portion of said enclosure;

means for promoting engagement between said handle and said tool bit enclosure;

means for biasing said enclosure into cooperative engagement with said handle;

means for securing preselected tool bits to said tool bit enclosure; and means for coupling any one of said preselected tool bits to a distal end of said shank.

26. The device of claim 25 wherein said cylindrical periphery and said base portion of said enclosure include means for maintaining the position of said cylindrical periphery in relation to said cylinder while said tool bit is removed from said selected recess in said cylinder.

27. The device of claim 15 wherein said cylindrical periphery is rotatable upon a base portion of said enclosure.

28. The device of claim 27 wherein said cylindrical periphery and said base portion of said enclosure include means for maintaining the position of said cylindrical periphery in relation to said cylinder while said preselected tool bit is removed from said corresponding recess in said cylinder.

29. The device of claim 26 wherein said maintaining means include a plurality of "V" shaped "teeth" protruding from a lower portion of said cylindrical periphery, and an equal quantity of cooperating "V" shaped notches in a corresponding upper portion of said base portion of said enclosure, one of said teeth ultimately engaging a corresponding notch to thereby "lock-in" the position of said cylindrical periphery when said enclosure is in a biased position.

30. The device of claim 28 wherein said maintaining means include at least one "V" shaped "tooth" protruding from a lower portion of said cylindrical periphery, and an equal quantity of cooperating "V" shaped notches in a corresponding upper portion of said base portion of said enclosure, one of said teeth ultimately engaging a corresponding notch to thereby "lock-in" the position of said cylindrical periphery when said enclosure is in a biased position.

31. A hand tool device comprising:

a handle having first and second recesses in a first end;

a shank cooperatively joined to said handle;

a base member having an aperture that receives said shank therethrough; and a biasing member having a first end secured to a preselected portion of said first recess of said handle, and a second end secured to a preselected portion of said base member such that said biasing member urges said base member into cooperative engagement with an end portion of said handle to unobtrusively insert a plurality of tool bits removably secured to a portion of said base member into said second recess of said handle whereupon said biasing member is enclosed by a periphery configured from said base member engaging said handle.

32. The device of claim 31 said biasing member includes a spring.

33. The device of claim 32 wherein laid shank is axially aligned with and longitudinally inserted through said spring.

34. The device of claim 31 wherein said handle includes a second end having a third recess disposed therein.

35. The device of claim 34 wherein said third recess is axially aligned with said shank.

36. The device of claim 31 wherein said first and second recesses are axially aligned.

37. The device of claim 34 wherein said third recess is configured to impart rotary motion upon any one of said plurality of tool bits after being snugly inserted into said third recess.

38. The device of claim 31 wherein said device includes means for coupling any one of said plurality of tool bits to a distal end of said shank.

39. The device of claim 31 wherein said aperture in said base member is configured to snugly receive said shank therethourgh whereby said base member is guided by said shank when an individual forcibly separates said base member from said handle thereby longitudinally expanding said biasing member to ultimately remove a selected tool bit from said base member.

40. The device of claim 31 wherein said handle and base member are transparent.

41. The device of claim 31 wherein said handle and base member include means for maintaining the position of said base member relative to said handle.

42. The device of claim 31 wherein said base member includes a cylinder having a plurality of recesses, each of said recesses removably receiving a tool bit therein, said base member further including a cylindrical periphery with one aperture that cooperates with one of said plurality of recesses of said cylinder to allow access to a tool bit in a selected recess while said base member is disengaged from said handle.

43. The device of claim 42 wherein said cylindrical periphery is rotatable upon said base member.

44. The device of claim 31 wherein said handle includes a removable second end portion having a recess for snugly receiving one of laid tool bits.

* * * * *